United States Patent [19]

Karls et al.

[11] Patent Number: 4,832,639

[45] Date of Patent: May 23, 1989

[54] MARINE DRIVE WITH AIR TRAP IN AUXILIARY WATER INLET

[75] Inventors: Michael A. Karls, Hilbert; James C. Dutcher, Oshkosh, both of Wis.

[73] Assignee: Brunswick Corporation, Skokie, Ill.

[21] Appl. No.: 160,192

[22] Filed: Feb. 25, 1988

[51] Int. Cl.[4] ..... B63H 21/26

[52] U.S. Cl. ..... 440/88

[58] Field of Search ..... 440/88, 78, 89; 417/503

[56] References Cited

U.S. PATENT DOCUMENTS 3,323,502 6/1967 Whalen ..... 440/88

4,392,779 7/1983 Bloemers et al. ..... 440/89

FOREIGN PATENT DOCUMENTS 0079093 6/1981 Japan ..... 440/88

OTHER PUBLICATIONS

Suzuki Dual Water Intake.

*Primary Examiner*—Sherman D. Basinger

*Attorney, Agent, or Firm*—Andrus, Sceales, Starke & Sawall

[57] ABSTRACT

A marine propulsion unit (10) has a depending gearcase (12) with one or more water inlet openings (22) in the sides of the gearcase for supplying water to a water pump (20), and an auxiliary water inlet opening (32) at an anti-ventilation plate (30) above the propeller (14) for supplying additional water to the water pump (20). The water passage (42, 50) from the auxiliary water inlet opening (32) to the water pump (20) has a portion (44, 52) extending downwardly below the level of the auxiliary water inlet opening (32) and communicating with the side water inlet openings (22). When the side water inlet openings (22) are below the water line and the auxiliary water inlet (32) is above the water line, water is received in the downwardly extending portion (44, 52) of the second passage (42, 50) and blocks air from flowing from the auxiliary inlet opening (32) to the water pump (20), to prevent engine overheating.

7 Claims, 2 Drawing Sheets

MARINE DRIVE WITH AIR TRAP IN AUXILIARY WATER INLET

BACKGROUND AND SUMMARY

The invention relates to a marine propulsion unit having a depending gearcase with water inlet openings on the sides for supplying water to a water pump, and an auxiliary water inlet opening at an anti-ventilation plate for supplying additional water to the water pump.

It is standard to provide water inlets on the sides of a depending gearcase of a marine propulsion unit. These side water inlets function well even with the engine mounted at high transom heights, including when the anti-ventilation plate over the propeller is above the water line. However, such side inlets are subject to clogging or plugging at low speeds if weeds or debris wrap around the gearcase strut. It is known in the prior art to provide an auxiliary water inlet opening under the anti-ventilation plate to solve the weed clogging problem. The propeller is spinning beneath such auxiliary water inlet openings and keeps such opening clean and free of weeds and debris, whereby sufficient water is supplied through such opening to the water pump. However, when running at high speed with the engine raised higher out of the water, or at extreme trim angles, such auxiliary water inlet opening may be raised above the water line. This in turn enables air to be sucked in to the water pump, even though the standard side water inlets are submerged. The sucked-in air reduces the amount of cooling water which can be supplied by the pump, and may cause overheating of the engine.

The present invention provides an air trap in the water passage from the auxiliary water inlet opening to the water pump even when the auxiliary water inlet opening is exposed to air, provided the side water inlet openings are submerged.

DESCRIPTION OF PRIOR ART

Figure 1:
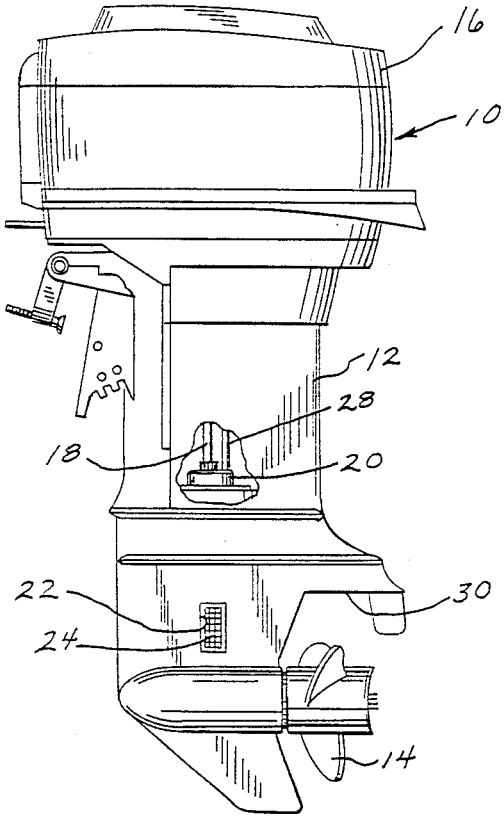
FIG. 1 is a side view of a marine propulsion unit with a depending gearcase.
Figure 2:
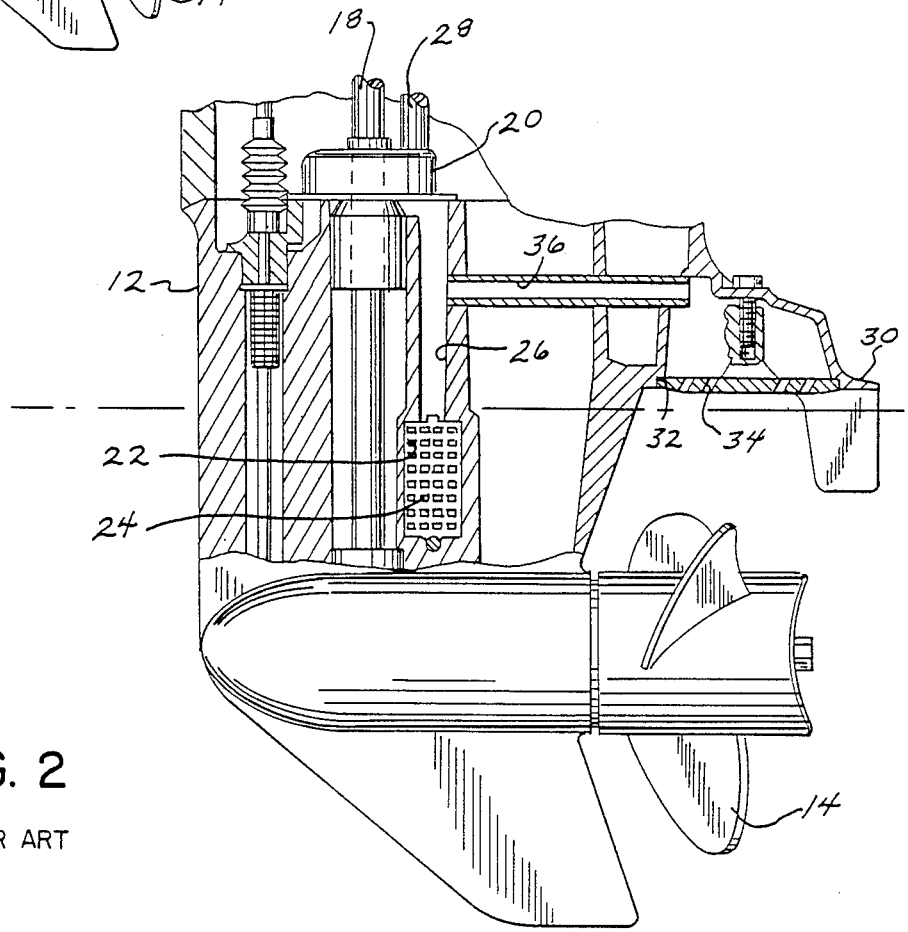
FIG. 2 PRIOR ART
FIG. 2 is an enlarged view of a portion of the structure of FIG. 1, partially in section, showing the prior art.

FIGS. 1 and 2 show a marine propulsion unit 10 having a depending gearcase 12 with a rear propeller 14. Cowl 16 houses an internal combustion engine (not shown) which drives a vertical drive shaft 18 which in turn rotates a horizontal propeller shaft (not shown) to which propeller 14 is mounted. Driveshaft 18 extends through and drives a water pump 20, as shown in U.S. Pat. No. 4,392,779, incorporated herein by reference. A left side water inlet opening 22 and a right side water inlet opening (not shown) are provided in the sides of gearcase 12, and may have inserts such as 24, and supply water through an upwardly extending vertical water passage 26 in the gearcase to water pump 20, which in turn supplies cooling water through water line 28 to the engine.

Anti-ventilation plate 30 extends horizontally on the gearcase above propeller 14 and has an auxiliary water inlet opening 32 along its underside with a screen or mesh 34 and supplies water through passage 36 to water passage 26 and water pump 20.

DESCRIPTION OF THE INVENTION

Figure 3:
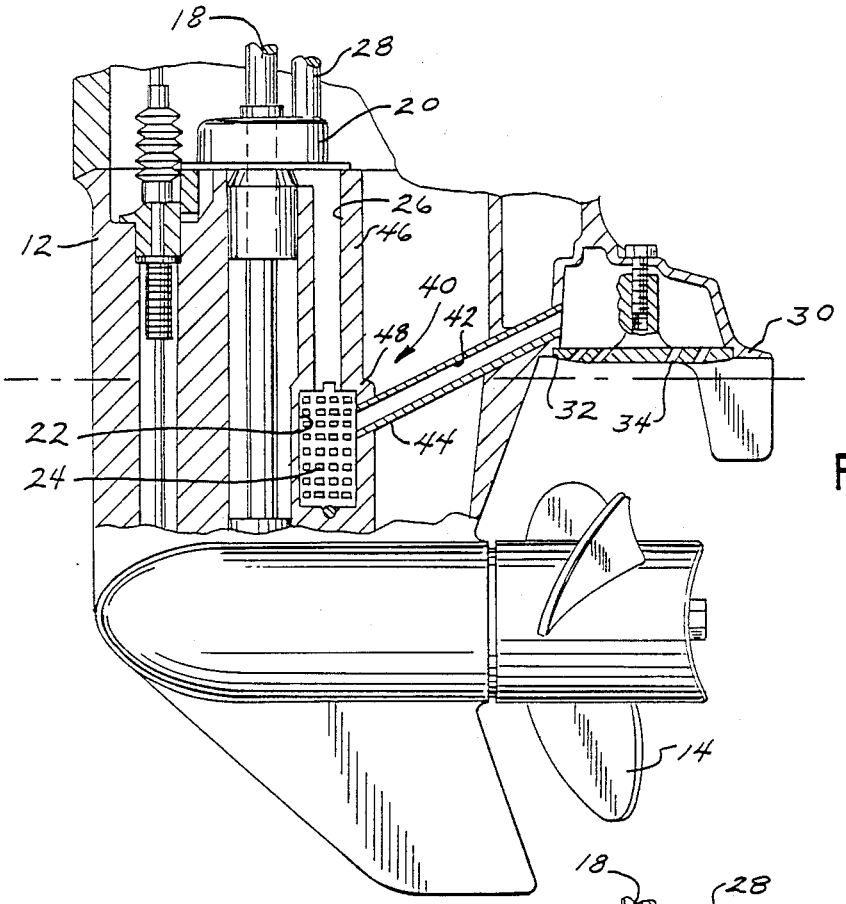
FIG. 3 is a view like FIG. 2, but showing the present invention.

FIG. 3 shows a marine propulsion unit in accordance with the invention and uses like reference numerals from FIGS. 1 and 2 where appropriate to facilitate clarity. The drive unit in FIG. 3 includes auxiliary water inlet opening 32 at anti-ventilation plate 30 for supplying additional water to water pump 20, and includes a trap 40 in gearcase 12 between auxiliary water inlet opening 32 and water pump 20. Trap 40 prevents air from being drawn into water pump 20 from auxiliary water inlet opening 32 when water inlet opening 22 in the side of the gearcase is below the water line and auxiliary water inlet opening 32 is above the water line when the drive unit is raised sufficiently out the water at high speed or at extreme trim angles. Water passage 26 extends from water inlet opening 22 in the side of the gearcase upwardly to water pump 20, as in FIG. 2. Water passage 42 extends from auxiliary water inlet opening 32. Trap 40 is provided by a portion 44 of water passage 42 extending downwardly below the level of auxiliary water inlet opening 32 and communicating with water inlet opening 22 in the side of the gearcase and then extending upwardly through passage 26 to water pump 20. When side water inlet opening 22 is below the water line and auxiliary water inlet opening 32 is above the water line, water is received in the downwardly extending portion 44 of water passage 42 from side water inlet opening 22 and blocks air from flowing from auxiliary opening 32 through downwardly extending portion 44 of passage 42 to upwardly extending passage 26 to water pump 20. Passage 42 at lower portion 44 merges with passage 26 at side inlet opening 22. Water from auxiliary inlet opening 32 through passage 42 and water through side inlet opening 22 flow in common through passage 26 upwardly to pump 20. Dividing wall 46 has a lower end 48 at which the lower end 44 of passage 42 merges into passage 26.

Figure 4:
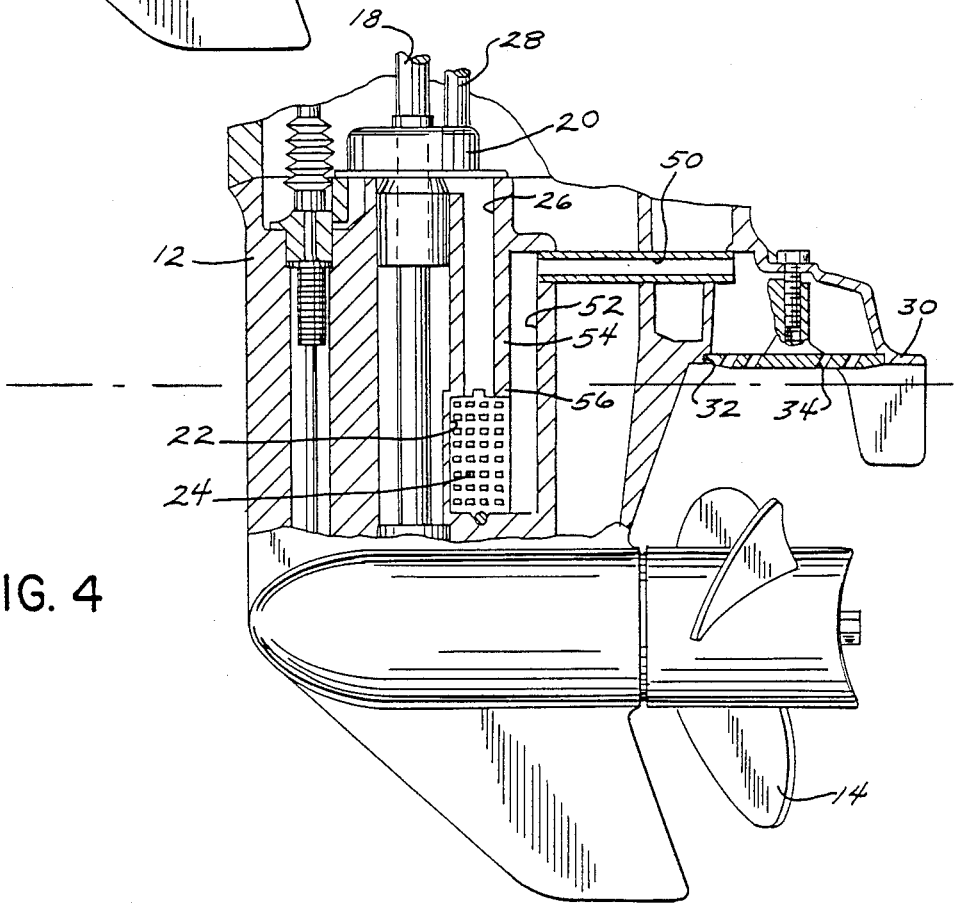
FIG. 4 is a view like FIG. 3 and shows an alternate embodiment.

FIG. 4 shows an alternate embodiment of the structure in FIG. 3 and uses like reference numerals where appropriate to facilitate clarity. Passage 50 in the gearcase extends from auxiliary water inlet opening 32 and has a portion 52 extending downwardly below the level of auxiliary opening 32 and communicating with side inlet opening 22 and then extending upwardly through passage 26 to water pump 20. When side inlet opening 22 is below the water line and auxiliary water inlet opening 32 is above the water line, water is received in downwardly extending portion 52 of passage 50 from side water inlet openings 22 and blocks air from flowing from opening 32 through downwardly extending portion 52 of passage 50 to upwardly extending passage 26 to water pump 20. As in FIG. 3, passage 50 at downwardly extending portion 52 merges with passage 26 at side water inlet opening 22. Water from auxiliary water inlet opening 32 through passage 50 and downwardly from side inlet opening 22 upwardly through passage 26 to water pump 20. Dividing wall 54 in the gearcase has a lower end 56 at which passage 50 at downwardly extending portion 52 merges into passage 26 at side water inlet opening 22. Dividing wall 54 has a rear surface defining downwardly extending passage portion 52 therealong, and has a front surface defining upwardly extending passage 26.

It is recognized that various equivalents, alternatives and modifications are possible within the scope of the appended claims.

We claim:

1. A marine propulsion unit comprising a depending gearcase with a rear propeller, one or more water inlet openings in the sides of said gearcase forward of said propeller for supplying water to a water pump, an anti-ventilation plate on said gearcase above said propeller, an auxiliary water inlet opening in said gearcase at said anti-ventilation plate for supplying additional water to said water pump, a passive gravity fed trap in said gearcase below the water line and between said auxiliary water inlet opening and said water pump preventing air from being drawn into said water pump from said auxiliary water inlet opening when said first mentioned one or more side water inlet openings are below the water line and said auxiliary water inlet opening is above the water line.

2. A marine propulsion unit comprising a depending gearcase with a rear propeller, one or more water inlet openings in the sides of said gearcase forward of said propeller for supplying water to a water pump, an anti-ventilation plate on said gearcase above said propeller, an auxiliary water inlet opening in said gearcase at said anti-ventilation plate for supplying additional water to said water pump, a trap in said gearcase between said auxiliary water inlet opening and said water pump preventing air from being drawn into said water pump from said auxiliary water inlet opening when said first mentioned one or more side water inlet openings are below the water line and said auxiliary water inlet opening is above the water line, a first water passage in said gearcase extending from said one or more side water inlet openings upwardly to said water pump, and comprising a second water passage in said gearcase extending from said auxiliary water inlet opening, and wherein said trap comprises a portion of said second passage extending downwardly below the level of said auxiliary water inlet opening and communicating with said one or more side water inlet openings and then extending upwardly to said pump, such that when said one or more side water inlet openings are below the water line and said auxiliary water inlet opening is above said water line, water is received in said downwardly extending portion of said second passage from said one or more side water inlet openings and blocks air from flowing from said auxiliary water inlet opening through said downwardly extending portion of said second passage to said upwardly extending portion of said second passage to said water pump.

3. The invention according to claim 2 wherein said second passage merges with said first passage at said one or more side water inlet openings.

4. The invention according to claim 3 wherein said first passage and said upwardly extending portion of said second passage extend in common upwardly to said water pump.

5. The invention according to claim 2 comprising a dividing wall in said gearcase having a lower end at which said second passage merges into said first passage.

6. The invention according to claim 5 wherein said lower end of said dividing wall is proximate said one or more side water inlet openings.

7. The invention according to claim 6 wherein said dividing wall has a rear surface defining said downwardly extending portion of said second passage therealong, and has a front surface defining said first passage and said upwardly extending portion of said second passage in common therealong.

* * * * *